US008534004B2

(12) United States Patent
Wasson et al.

(10) Patent No.: US 8,534,004 B2
(45) Date of Patent: Sep. 17, 2013

(54) RAPID DEPLOYMENT AND RETRACTION TELESCOPING MAST SYSTEM

(75) Inventors: Andrew Paul Wasson, Wooster, OH (US); Michael James Kardohely, West Salem, OH (US)

(73) Assignee: The Will-Burt Company, Orrville, OH (US)

( * ) Notice: Subject to any disclaimer, the term of this patent is extended or adjusted under 35 U.S.C. 154(b) by 117 days.

(21) Appl. No.: 12/940,510

(22) Filed: Nov. 5, 2010

(65) Prior Publication Data

US 2012/0079778 A1 Apr. 5, 2012

Related U.S. Application Data

(60) Provisional application No. 61/388,192, filed on Sep. 30, 2010.

(51) Int. Cl.
*E04H 12/34* (2006.01)

(52) U.S. Cl.
USPC ..... 52/114; 52/115; 52/118; 52/121

(58) Field of Classification Search
USPC ..... 52/114, 115, 118, 121, 632; 343/883, 343/878
See application file for complete search history.

(56) References Cited

U.S. PATENT DOCUMENTS

| | | | | |
|---|---|---|---|---|
| 2,676,677 | A * | 4/1954 | Anderson et al. | 92/137 |
| 3,032,147 | A | 5/1962 | Wilkinson et al. | |
| 3,563,043 | A * | 2/1971 | Nelson | 405/202 |
| 3,688,455 | A | 9/1972 | Zebuhr | |
| 4,176,360 | A * | 11/1979 | Leavy et al. | 343/883 |
| 5,128,688 | A | 7/1992 | West | |
| 5,139,464 | A | 8/1992 | Lehnert | |
| 5,168,679 | A * | 12/1992 | Featherstone | 52/118 |
| 5,333,422 | A * | 8/1994 | Warren et al. | 52/115 |
| 5,718,087 | A * | 2/1998 | Featherstone et al. | 52/121 |
| 6,046,706 | A * | 4/2000 | Vargas | 343/883 |
| 6,290,377 | B1 * | 9/2001 | Hulse | 362/385 |
| 6,494,636 | B1 * | 12/2002 | Mozena | 403/109.2 |
| 6,767,115 | B2 * | 7/2004 | Blackwelder | 362/385 |
| 7,574,832 | B1 * | 8/2009 | Lieberman | 52/118 |
| 7,768,473 | B2 * | 8/2010 | Kardohely | 343/883 |
| 7,966,777 | B2 * | 6/2011 | Douglas et al. | 52/118 |

FOREIGN PATENT DOCUMENTS

GB 2075567 11/1981

OTHER PUBLICATIONS

International Search Report dated Oct. 18, 2011.

* cited by examiner

*Primary Examiner* — Brian Glessner
*Assistant Examiner* — Adriana Figueroa
(74) *Attorney, Agent, or Firm* — Fay Sharpe LLP

(57) ABSTRACT

A rapid deployment and retraction telescoping mast system for controlling the height of a mast. A retraction mechanism including a resilient member, a retraction reel, a reel shaft, and a motor disposed about a frame. The resilient member extends from the retraction reel and is rigidly attached to a top tube of the mast through a sealed passage. The reel shaft rotates the retraction reel and winds the resilient member creating a retraction force on the top tube causing controlled retraction of the mast. A deployment mechanism including a compressor, storage tank, exhaust valve and isolation valve arranged about the frame and in communication with the mast. The compressor generates pressurized air to be communicated to the mast when the isolation valve is in the open position. The increase of pressure generated by the deployment mechanism provides a force within the mast thereby controlling its deployment.

12 Claims, 3 Drawing Sheets

RAPID DEPLOYMENT AND RETRACTION TELESCOPING MAST SYSTEM

A claim for domestic priority is made herein under 35 U.S.C. §119(e) to U.S. Provisional App. Ser. No. 61/388,192 filed on Sep. 30, 2010, the entire disclosure of which is incorporated herein by reference.

BACKGROUND

The present exemplary embodiment relates to a rapid deployment and retraction telescoping mast system. It finds particular application in conjunction with telescoping masts relating to police, fire fighting, rescue, security, military, and communication industries, and will be described with particular reference thereto. However, it is to be appreciated that the present exemplary embodiment is also amenable to other like applications.

Telescoping mast systems can be operated in a variety of ways. It is common in the art to operate telescoping mast systems automatically by hydraulic or pneumatic actuation whereby a series of tubes are expanded to a desired height from a nested position by pressurized fluid or gas. In this instance, the mast is in communication with a compressor and/or a pressurized tank to provide pressurized fluid or gas to a series of cylindrical tubes. However, it is also known to operate the extension and retraction of a mast by mechanical means comprising a series of cables, ropes, winches or pulleys.

The body of the mast includes a series of tubes that typically comprise cylindrical shaped bodies, each having a generally hollow interior wherein each cylinder is interconnected with a passage for communication therethrough. Each tube generally has a flanged lip radially disposed away from a central axis at a bottom end and a flanged lip radially disposed toward the axis at a top end. The tubes concentrically engage one another wherein the exterior tube has a width greater than a first intermediate tube disposed therein. The first intermediate tube having a greater width than a second intermediate tube disposed therein and so on. This arrangement can comprise any number of tubes wherein the pinnacle of the mast includes a top tube having a width that is smaller than any other tube in the mast. The top tube is attached to the load intended to be deployed and/or retracted.

The plurality of tubes comprises a pressurized envelope that is typically achieved with a gasket or sleeve disposed between each tube. The sleeve can be made of an elostomeric or rubber type compound and maintains a seal between each tube while also allowing movement without pressure seepage. The tubes are deployed to a desired height and can be secured in place by maintaining the pressure within the mast.

Retraction of the mast is generally achieved by allowing gravitational forces to return the tubes and associate load to a nested position. This requires pressure to be vented from the envelope which is a function of the gravitational pull, the friction between the sleeves and tubes and the weight of the mast and load. The speed of this retraction is dependent on the payload weight and the surrounding environmental conditions.

Retractable poles and masts have been fabricated mostly from aluminum, with a few devices made of fiberglass. Such prior designs are typically bulky and may use complicated networks of pressurized air, cables, and pulleys to extend or collapse the poles, resulting in a time-consuming operation each time the apparatus is to be extended or retracted.

Pneumatic telescoping mast systems are typically retracted by opening an air release valve and allowing gravity to return the tubes and payload to the nested position. The speed of this retraction is dependent on the payload weight and the surrounding environmental conditions.

However, retraction of such a pole by its own weight necessitates the use of a pole with sufficient weight to accomplish such retraction in an efficient manner. Depending on the application, this variable retraction speed can pose risk to an associate operator and overall efficiency of the system. Therefore, it is desirable to have a rapid deployment and retraction mast to allow the operator the ability to quickly deploy and retract the mast in a consistent and repeatable fashion. There remains a need for a device and method for a controlled extendable and retractable telescoping mast which may be both quickly extended and retracted.

BRIEF DESCRIPTION

The present disclosure relates to a rapid deployment and retraction telescoping mast system. The disclosed system comprising a frame including a base for connection to an associate surface and a plurality of interconnected tube sections vertically disposed on the base. The tube sections including a base tube and a top tube and at least one intermediate tube there between. Each tube section comprising a generally hollow body wherein each tube is axially aligned with each of the plurality of tubes and defining a shared passage therethrough. The plurality of tube sections maintains an envelope having a pressurized seal arrangement.

One object of the disclosure provides a deployment mechanism including a compressor, storage tank, exhaust valve and isolation valve arranged about the frame and in communication with the plurality of interconnected tube sections. The compressor is in communication with the storage tank to generate pressurized air for storage in the tank. The storage tank is in communication with the plurality of tubes in series arrangement with the isolation valve wherein the tank becomes isolated from the plurality of tubes during non-operation while the isolation valve is closed. Compressed air is introduced into the plurality of tubes when the isolation valve is in the open position wherein increasing the pneumatic pressure within the sealed envelope of the plurality of tubes. The increase of pressure generated by the deployment mechanism provides a deployment force within the plurality of interconnected tubes causing controlled deployment of the telescoping mast.

An additional object of the disclosure provides a retraction mechanism including a resilient member, a retraction reel, a reel shaft, and a motor disposed about the frame. The retraction reel and at least a portion of the reel shaft are disposed within a sealed housing. The resilient member extends from the retraction reel and is rigidly attached to the top tube of the plurality of tube sections through a resilient passage. The resilient passage is sealed and in communication with the hollow sealed passage defined by the plurality of interconnected tubes. The retraction reel includes an arcuate edge radially extending from a central axis. The resilient member rotably engages the retraction reel at the arcuate edge and the reel shaft axially engages the retraction wheel at the central axis. The reel shaft adapts to a motor to introduce mechanical force to the retraction mechanism whereby upon operation of the motor, the reel shaft rotates the retraction reel and winds the resilient member creating a retraction force on the top tube causing controlled retraction of the telescoping mast. At the time the retraction mechanism is operated, the exhaust valve, in communication with the plurality of tubes, is opened to allow for the reduction of pressure. The exhaust valve and motor can be toggled for optimal control over the retraction speed of the mast.

In one embodiment, the plurality of telescoping tubes include sliding and sealing surfaces between the tubes, a first plug member on the upper end of the smallest cylinder, and a second plug member on the lower end of the largest cylinder, wherein pressurize air admitted to the base tube and cause the deployment of the tubes to slide relative to one another causing the mast to extend. An elastomeric sleeve connects a tube with one of the intermediate tubes to seal one tube to another when the mast is fully extended. The elastomeric sleeve further serves to provide a cushion to prevent damage to the cylinders when the pole is urged back into a nest position by the retraction mechanism and the venting of the pressure.

Yet another embodiment provides a controller box in electrical communication with the compressor, isolation valve, exhaust valve, storage tank, motor and associate sensing and controlling elements. A potentiometer device is provided about the reel shaft to communicate reel shaft frequency data to the controller box. The controller box may be used to record and store data as well as manipulate known toggleable functions of the associate elements within the system.

In yet another embodiment, a torsion spring is provided in the housing to provide a supporting force to the retracting reel therein reducing undesired slack of the resilient member.

A further embodiment provides a clutch bearing operably coupled between the reel shaft and the motor to allow free rotation of the reel shaft and retraction reel in the direction of motor rotation when not engaged. The clutch bearing also allows the transfer of torque from the motor to the reel shaft in the retraction direction when engaged.

An advantage of the present disclosure is a device that rapidly deploys and retracts a plurality of interconnected tubes with a controllable and consistent rate In a further advantage of the present disclosure is to provide the repeatable retraction time required for a telescoping mast under all environmental conditions and mast orientations. Particularly, consistency problems for mast operation within cold temperatures and at angled grades are overcome by this disclosure.

It is also an advantage of the present disclosure to provide a telescoping mast system having a design architecture with a lower cost than other mast devices.

Still other features and benefits of the present disclosure will become apparent from the following detailed description.

DETAILED DESCRIPTION

It is to be understood that the detailed figures are for purposes of illustrating exemplary embodiments only and are not intended to be limiting. Additionally, it will be appreciated that the drawings are not to scale and that portions of certain elements may be exaggerated for the purpose of clarity and ease of illustration.

In accordance with the present disclosure a system and method are provided which automatically control the deployment and retraction of a telescoping mast system. The system can be used to provide hoisting for all types of applications including but not limited to personnel lifts, communication towers, antennas, satellites, material hoists, platforms, and any other application that requires displacement from the base to a predetermined height.

The mast system combines the positive aspects of a pneumatic mast system and mechanical retraction mechanism for the purpose of rapid deployment and retraction of a telescoping mast system. The system combines the low cost benefits of a pneumatic mast with the controlled motion and positive retraction force of a mechanical mast. Disclosed is a pneumatic mast equipped with a mechanical retraction system. This system consists of a powered reel and automated pneumatic exhaust valve. To maintain the pneumatic sealing integrity of the mast, the powered reel mechanism is integrated within a pressure vessel.

Figure 1:
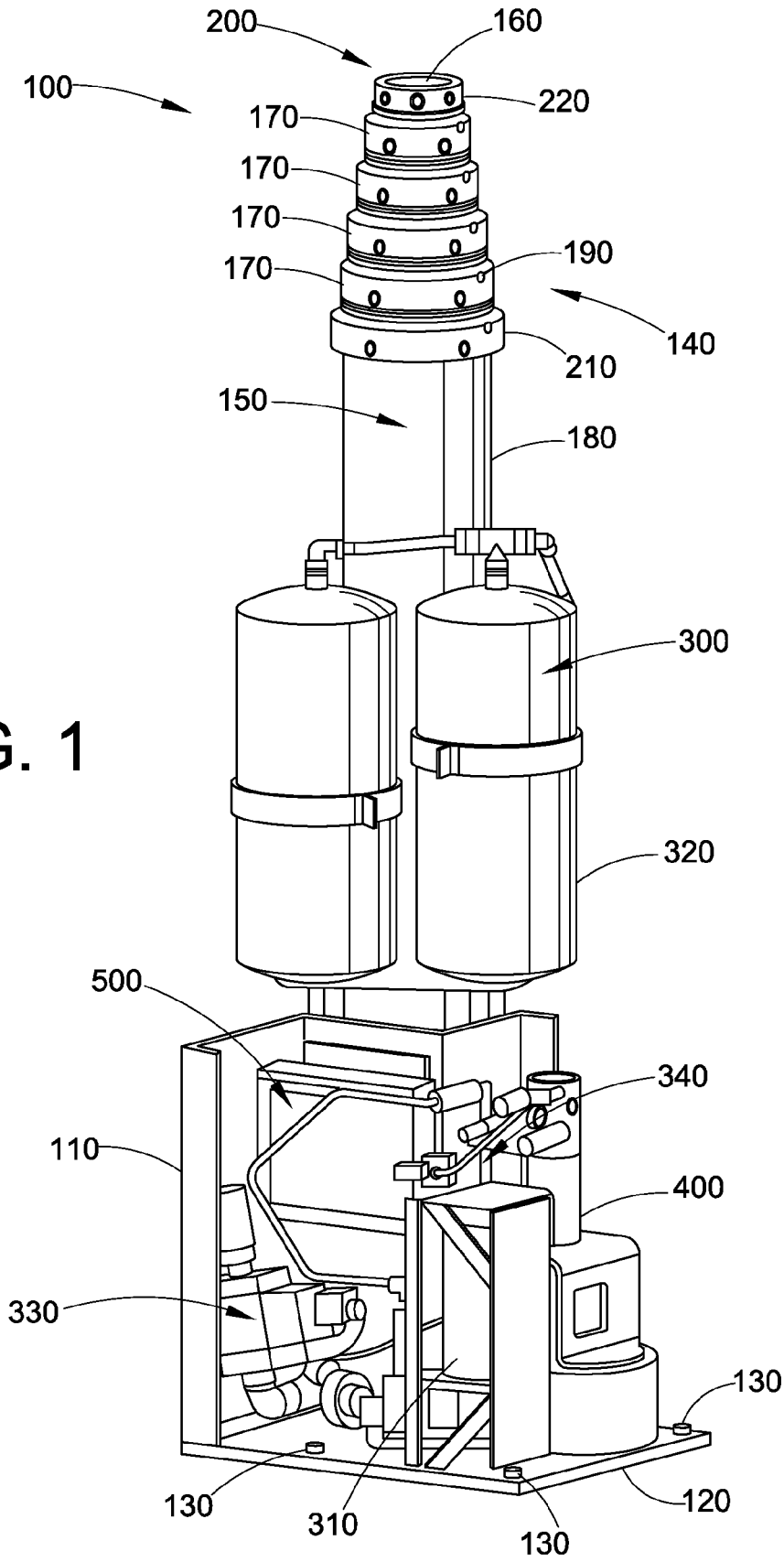
FIG. 1 is a perspective view of the rapid deployment and retraction telescoping mast system.
Figure 3:
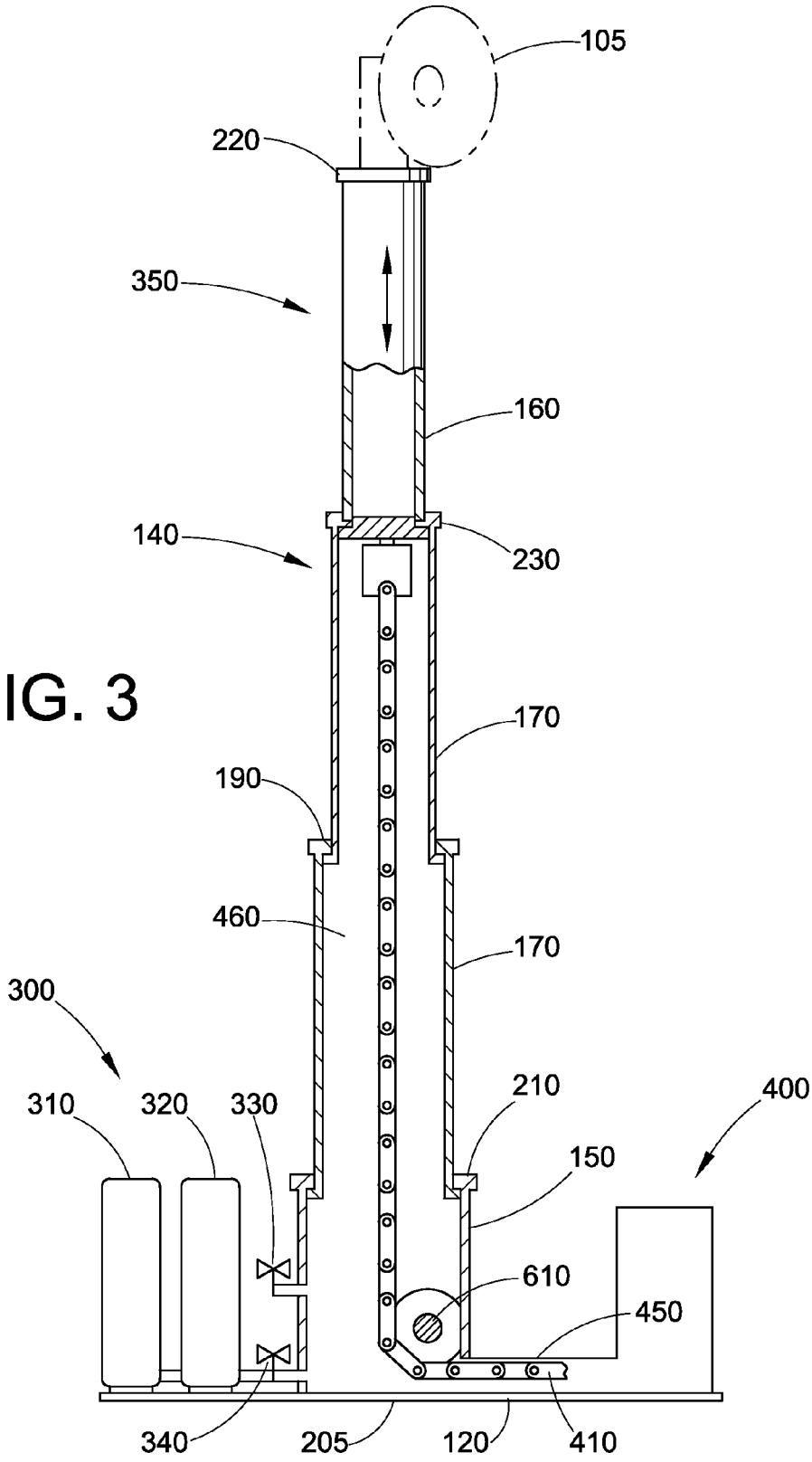
FIG. 3 is a sectional view of the plurality of interconnecting tubes and a schematic view of the deployment mechanism and the retraction mechanism of the telescoping mast system.

With reference to FIG. 1 & FIG. 3, a telescoping mast system 100 controls the rapid deployment and retraction of an associate load 105. The telescoping mast system 100 includes a frame 110 for securing different elements of the system. The frame 110 includes a base 120 for adapting the telescoping mast system to an associate surface. The base 120 includes a plurality of anchors 130 for a stable connection to the surface. The anchors 130 should be rigidly connected to ensure a safe, consistent operation of the telescoping mast system 100. It is to be understood that an unsuitable base 120 connection would increase the risk of improper operation whereby the system 100 would be subject to tipping, shaking or falling.

A plurality of interconnected tube sections 140 are vertically joined to the base 120. The tube sections 140 include a base tube 150 and a top tube 160 with intermediate tubes 170 there between. Each tube section 140 comprises a generally hollow body 180 wherein the base tube 150 is axially aligned to the intermediate tubes 170 and the top tube 160. The plurality of tubes 140 define a hollow shared passage 460 from the combination of hollow bodies. The plurality of tubes 140 maintain an envelope having a pressurized seal arrangement.

The plurality of tubes 140 may include a plurality of sliding and sealing surfaces 190 between the tubes 140. The sealing surfaces 190 comprise an elastomeric sleeve 190 that connects at least the base tube 150 with one of the intermediate tubes 170 to seal one tube to another when the mast system 100 is fully extended. The elastomeric sleeve also provides a cushion to prevent damage to the cylinders when the pole is urged back into a nest position 200 as shown. The base tube 150 has a closed first end 205 opposing a second end 210 that interconnects intermediate tubes 170. The top tube 160 has a closed first end 220 opposing a second end 230 away from the base 120, thereby creating a sealed envelope within the hollow bodies of the plurality of tubes 140. The sealed envelope allows pressurized air to enter the base tube 150 without pressure leakage and helps deploy the tubes 140 relative to one another causing the mast to extend vertically.

A deployment mechanism 300 is provided about the frame 110 of the telescoping mast system to automatically control the deployment function of the system. The deployment mechanism 300 includes a compressor 310, at least one storage tank 320, an exhaust valve 330 and an isolation valve 340. In the preferred embodiment of FIG. 1, the compressor 310 is located on the base 120 of the frame 110 and maintains pressurized communication with the storage tank 320 while the storage tank 320 is structurally adapted to the base tube 150. The exhaust valve 330 and isolation valve 340 are also provided about the frame 110. It is noted that this organizational structure is not limited to this arrangement as any other structural locations for the different elements is also covered by this disclosure.

The isolation valve 340 is aligned in a passage that remains in communication between the storage tank 320 and the base tube 150. The isolation valve 340 may comprise any type of plumbing, hydraulic or pneumatic type shut off valve known in the prior art whereas an electrical solenoid valve is preferable. The passage may comprise any durable plumbing material suitable to allow the transfer of pneumatic pressure in a controlled manner while preventing unnecessary pressure loss due to leaks. Utilizing stored energy in the form of compressed air allows rapid deployment that is not dependent on the flow rate of the compressor. The width of the passage as it exists between the isolation valve 340 and the base tube 150 can be adjusted to increase or decrease the speed of the telescoping mast deployment. Deployment speed can also be tunable by adjusting the tank pressure or volume.

When engaged into operation, the compressor 310 generates pressurized air provided to the storage tank 320. Tank pressure is controlled by a pressure switch. The storage tank 320 remains in communication with the plurality of tubes 140 and in series alignment with the isolation valve 340 and the base tube 150. The isolation valve 340 may be automatically toggled by one or more signals provided by a control box 500, which is in electrical communication with the isolation valve 340. The isolation valve 340 range between opened and closed can be modulated to provide more precise control over the pressurized air provided from the storage tank 320 to the base tube 150. Compressed air is introduced into the plurality of tubes 140 when the isolation valve 340 is in the open position thereby increasing the pneumatic pressure within the sealed envelope of the plurality of tubes 140. The increase of pressure generated by the deployment mechanism provides a deployment force within the plurality of interconnected tubes. The deployment force acts on the plurality of tubes 140 to urge each tube into an extended position 350. The isolation valve 340 remains closed during the non-operation of the system or otherwise while the system is at rest. The plurality of tubes may remain at rest while in the nest position 200 or at rest in the extended position 350.

Figure 2:
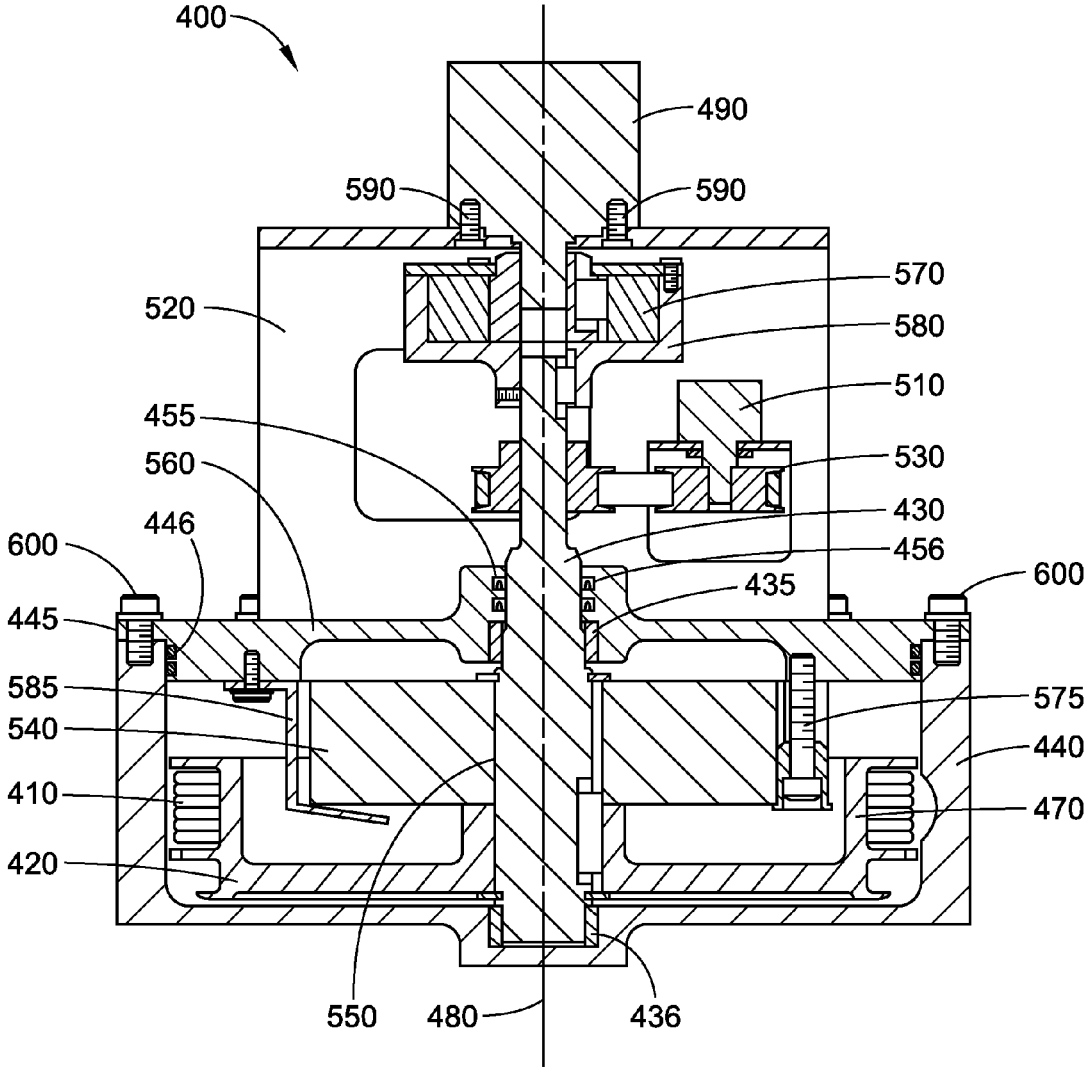
FIG. 2 is cross sectional schematic view of the retraction mechanism.

The retraction mechanism 400 is depicted in FIGS. 1 and 2 but will be described in particularity as identified in FIG. 2. The retraction mechanism 400 includes a resilient member 410, a retraction reel 420, a reel shaft 430, and a motor 490 disposed about the base 120 of the frame 110. The retraction reel 420 and at least a portion of the reel shaft 430 are disposed within a pneumatically sealed housing 440. The sealed housing 440 maintains a pressurized volume by utilizing static O-ring seals 445 on the housing cover and rotating shaft U-cup seals 455 on the reel shaft 430. The O-ring seals 445 are provided about a sealing wall 446 of a housing cover 560 and are provided in sealing engagement with the sealed housing 440 to help prevent pressure leaks. The U-cup seals 455 are provided about a sealing wall 456 of the housing cover 560 at a location surrounding the shaft reel 430. The U-Cup seals 455 dynamically and seallingly engage the reel shaft 430 to help prevent pressure leaks from the sealed housing 440 while the reel shaft 430 is rotated. At least a portion of the reel shaft 430 is located within the sealed housing 440 and engages axial sleeve bearings 435, 436 for consistent dynamic rotational motion between the reel shaft 430, the sealed housing 440 and the housing cover 560.

The motor 490 is supported and attached to a mounting bracket 520 by mechanical fasteners 590. The housing cover 560 is sealingly attached to the sealed housing 440 by mechanical fasteners 600. The resilient member 410 may comprise any material known in the art to that provides a connection between multiple elements allowing a pulling force sufficient to overcome a predetermined weight of a load to be deployed and retracted. Capable resilient members 410 may include but not be limited to bungee cords, rope, chain, cable, straps, nylon, rubber, etc.

In a preferred embodiment that can be better understood by FIG. 3, the resilient member 410 extends from the retraction reel 420 and is rigidly attached to the top tube 160 of the plurality of tube sections through an internal resilient passage 450. The resilient passage 450 is sealed and defines a pressurized communication pathway between the hollow sealed passage 460 defined by the plurality of interconnected tubes 140 and the sealed housing 440. As can be appreciated in FIG. 2, the retraction reel 420 includes an arcuate edge 470 radially extending from a central axis 480. The resilient member 410 rotably engages the retraction reel 420 at the arcuate edge 470 and the reel shaft 430 engages the retraction reel 420 in axial alignment with the central axis 480.

The reel shaft 430 adapts to the motor 490 to introduce a rotational mechanical force to the retraction mechanism 400. Upon operation of the motor 490, the reel shaft 430 rotates the retraction reel 420 thereby winding the resilient member 410 about the retraction reel 420 and creating a retraction force on the top tube 160. The top tube 160 acts on all tube sections to mechanically retract the mast. A clutch bearing 570 is provided about a clutch housing 580 within the mounting bracket 520. The clutch housing 580 is axially aligned to the reel shaft 430 and motor 490 to allow the clutch bearing 570 to operatively engage the reel shaft 430 and to transfer the torque from the motor 490 to the reel shaft 430. The reel shaft 430 is coupled to the clutch housing with a key and set screw arrangement. The clutch bearing 570 engages the reel shaft 430 to transfer torque provided by the motor 490 and allows the reel shaft 430 to freely rotate (freewheel) in the same rotational direction as the winding of the resilient member 410. The clutch bearing 570 (also known as a one way bearing) is set in the clutch housing 580 with a press fit and is coupled to the motor using a key.

A torsion spring 540 is provided in the sealed housing 440 to provide a supporting force to the retraction reel 420. This supporting force helps to reduce extra slack of the resilient member 410 that may exist in mechanical winch type systems such as this. The torsion spring 540 is a multi-turn, mechanical spring which includes a dynamic end that attaches to the retraction reel 420 with a tab and slot arrangement 550. The opposing end of the torsion spring 540 is statically attached to a housing cover 560 with a screw 575. The torsion spring 540 acts on the retraction reel 420 in a direction that keeps the resilient member 410 in tension and generally removes the risk of slack development in the resilient member 410. The direction of this force is the same direction as the rotational force provided by the motor 490 and the free-wheeling direction due to the clutch bearing 570 and reel shaft 430 arrangement. The torsion spring 540 is also supported by a spring retainer 585 located within the sealed housing 440. The clutch bearing 570 allows the torsion spring torque to act without needing to energize the motor in the opposite direction. The clutch bearing 570 allows the torsion spring 540 to retract the resilient member 410 even if the rotation speed needed exceeds the retraction motor rotation speed. This might occur if gravity causes the mast to retract faster than the retraction motor speed dictates.

However, during deployment, the resilient member 410 is unwound from the retraction reel 420. The clutch bearing 570 applies torque in the direction that causes the motor 490 to be back-driven. The dynamic end of the torsion spring 540 rotates which increases the torque to a maximum value when the plurality of tubes 140 are fully extended.

At the time the retraction mechanism 400 is operated, the exhaust valve 330, in communication with the hollow passage 460 through the base tube 150, is opened to allow for the reduction of pressure influencing the downward motion of the tubes 140. The exhaust valve 330 orifice size, along with the power and speeds of the motor 490, can be toggled along with a designed diameter of the retraction reel 470 for optimal control over the retraction speed of the mast system. Additionally, the deployment and retraction speeds are a function of the dual operation of both the deployment mechanism 300 and the retraction mechanism 400. Adjustment or modulation of an element of the deployment mechanism 300 may have an effect on the speed of mast retraction and likewise adjustment or modulation of an element in the retraction mechanism 400 may have an effect on the speed of mast deployment.

The controller box 500 may be in electrical communication with the compressor 310, isolation valve 340, exhaust valve 330, storage tank 320, motor 490 and associate sensing and controlling elements. A potentiometer device 510 is provided within the mounting bracket 520 of the retraction mechanism to communicate with the reel shaft 430 by way of a pulley belt 530. Potentiometer devices are well known in the art to provide electronic computational signals in addition to other controlling features. The potentiometer 510 provides a signal to the controller box 500 indicating the rate and quantity of revolutions of the reel shaft 430 for optimal control and monitoring of the rotational speed of the retraction reel 420 and the telescoping mast system.

FIG. 3 provides a clear schematic depiction of the operational elements of the present disclosure and a partial cross sectional view of the plurality of tubes 140. The resilient member 410 extends from the retraction mechanism 400 and rotationally engages a pulley member 610. The pulley member rotationally directs the resilient member 410 towards a central axis of the plurality of tubes 140 in a generally perpendicular direction from the axis where the resilient member 410 extends from the retraction mechanism 400. The resilient member 410 rigidly connects to the top tube 160 at the second side 230. However, the resilient member 410 may also connect to the top tube 160 at the first side 220.

The telescoping mast system 100 rapidly deploys and retracts a plurality of interconnected tubes 140 with a controllable and consistent rate required for a telescoping mast under all environmental conditions and mast orientations. Particularly, consistency problems for mast operation within cold temperatures and at angled grades are overcome by this disclosure. These features are functional due to the pressurized envelope of the system as it is maintained with countervailing mechanical forces in a predetermined and programmable way thereby optimizing deployment and retraction speeds of the telescoping mast. This concept is scalable to different mast heights and diameters.

This disclosure particularly overcomes environmental conditions such as cold temperatures with frost build-up on the tubes and operating the mast at grades greater than horizontal as they cause difficulty with a purely pneumatic mast in regards to retraction time.

Other concepts to provide the rapid retraction function are as follows: Draw vacuum in the mast pressure chamber to allow atmospheric pressure on the outside of the tubes to provide a downward pressure differential force to retract the mast.

The exemplary embodiment has been described with reference to the preferred embodiments. Obviously, modifications and alterations will occur to others upon reading and understanding the preceding detailed description. It is intended that the exemplary embodiment be construed as including all such modifications and alterations insofar as they come within the scope of the appended claims or the equivalents thereof.

The invention claimed is:

1. A telescoping mast system comprising:

a frame;

a plurality of interconnected tube sections including at least a base tube, an intermediary tube and a top tube, each tube section comprises a substantially hollow body;

a retraction controller mechanism including a retraction reel coupled to a reel shaft, a motor and a resilient member extending therefrom, wherein the resilient member is attached to the plurality of interconnected tube sections to create a retraction force thereon, the retraction reel is located within a sealed housing, the sealed housing comprises at least a reel shaft seal; and a deployment controller mechanism in communication with the plurality of interconnected tube sections.

2. A telescoping mast system of claim 1, wherein a torsion spring operably interacts with the retraction reel.

3. A telescoping mast system of claim 1, wherein the retraction reel is coupled to the reel shaft, said reel shaft is coupled to a clutch mechanism.

4. A telescoping mast system of claim 1, wherein the deployment controller mechanism comprises a compressor, an exhaust valve and an isolation valve.

5. A telescoping mast system of claim 4, wherein the deployment controller mechanism comprises a pressurized storage tank in communication with an isolation valve and the plurality of tube sections.

6. A telescoping mast system of claim 1, wherein the base tube has a first width, the intermediate tube has a second width, the end tube as a third width, wherein the first width is greater than the second width, the second width is greater than the first width.

7. A telescoping mast system of claim 1, wherein each tube section comprises a substantially cylindrical shaped body.

8. A telescoping mast system comprising:

a frame including a base for connection to an associate surface;

a plurality of interconnected tube sections including at least a base tube and a top tube; said tube sections comprising a substantially hollow body; said top tube being axially aligned with the base tube; said plurality of tube sections include a substantially pressurized seal arrangement;

a retraction controller mechanism including a resilient member, retraction reel, reel shaft, and motor, said resilient member extending from the retraction reel and in communication with the top tube to provide a retraction force thereon to retract the plurality of interconnected tube sections along a common axis; said retraction reel axially engaged to the reel shaft;

a deployment controller mechanism in communication with the plurality of interconnected tube sections; said deployment controller mechanism comprising a compressor, storage tank, exhaust valve and isolation valve.

9. A telescoping mast system of claim 8, wherein the retraction controller mechanism includes a means to induce rigidity of the resilient member.

10. A telescoping mast system of claim 9, wherein the means to induce rigidity of the resilient member includes a clutch mechanism in axial alignment with said real shaft and said motor wherein said clutch mechanism allows for the at least one of a torque rotation and free rotation of said retraction reel.

11. A telescoping mast system of claim 8 further including a controller box, said controller box provides electronic control to the retraction mechanism and deployment mechanism.

12. A telescoping mast system of claim 8, wherein the retraction reel and at least a portion of the reel shaft are disposed within a sealed housing and a sealed passage defines a pressurized communication pathway between the seal arrangement of the plurality of pressurized tubes and the sealed housing.

* * * * *